US010085521B2

(12) United States Patent
Chen et al.

(10) Patent No.: US 10,085,521 B2
(45) Date of Patent: Oct. 2, 2018

(54) MAGNETIC BUCKLE

(71) Applicant: BUTTON INTERNATIONAL CO., LTD., Taipei (TW)

(72) Inventors: Chung Lung Chen, Taipei (TW); Fu Hao Li, Taipei (TW)

(73) Assignee: BUTTON INTERNATIONAL CO., LTD., Taipei (TW)

( * ) Notice: Subject to any disclaimer, the term of this patent is extended or adjusted under 35 U.S.C. 154(b) by 0 days.

(21) Appl. No.: 15/721,530

(22) Filed: Sep. 29, 2017

(65) Prior Publication Data

US 2018/0132570 A1 May 17, 2018

(30) Foreign Application Priority Data

Nov. 16, 2016 (TW) ..... 105137529 A

(51) Int. Cl.
*A44B 11/25* (2006.01)
*A45C 13/10* (2006.01)
*A41F 1/00* (2006.01)

(52) U.S. Cl.
CPC ..... *A44B 11/258* (2013.01); *A41F 1/002* (2013.01); *A45C 13/1069* (2013.01); *A44D 2203/00* (2013.01)

(58) Field of Classification Search
CPC ..... A45F 3/047; A44B 11/2592
See application file for complete search history.

(56) References Cited

U.S. PATENT DOCUMENTS 2,615,227 A * 10/1952 Hornik ..... A44C 5/2071 24/303
2,648,884 A * 8/1953 Loofboro ..... A44C 5/2071 24/303
3,589,341 A * 6/1971 Krebs ..... A01K 27/005 119/865
5,826,309 A * 10/1998 Tsamas ..... A44C 5/2052 24/265 WS
6,163,938 A * 12/2000 Weber-Unger ..... A41F 1/002 24/303
6,292,985 B1 * 9/2001 Grunberger ..... A44B 11/2592 24/303
6,505,385 B2 * 1/2003 Grunberger ..... A44B 11/2592 24/303

(Continued)

*Primary Examiner* — Jason W San
(74) *Attorney, Agent, or Firm* — Rabin & Berdo, P.C.

(57) ABSTRACT

A magnetic buckle includes two buckle bodies respectively have a magnetic attraction element fitted thereon. The two magnetic attraction elements bring the two buckle bodies to be magnetically detachably engaged with each other. A guide structure is formed on between the two buckle bodies. The two magnetic attraction elements and the guide structure together enable one of the two buckle bodies to move in different directions when it sequentially moves along an approaching path, within which the two buckle bodies are separate from each other, a contacting path, within which the two buckle bodies are brought to contact with each other, and a locating path, within which the two buckle bodies are brought to engage with each other. Thus, a user can conveniently magnetically engage the two buckle bodies with each other without the necessity of aligning them in advance or double-checking the engagement between them.

8 Claims, 13 Drawing Sheets

(56) References Cited

U.S. PATENT DOCUMENTS

| | | | | |
|---|---|---|---|---|
| 6,804,865 | B2 * | 10/2004 | Grunberger | A41F 1/002 24/303 |
| 6,857,169 | B2 * | 2/2005 | Chung | A44B 11/258 24/303 |
| 8,359,716 | B2 * | 1/2013 | Fiedler | A44B 11/25 24/303 |
| 8,484,809 | B2 * | 7/2013 | Fiedler | A45C 13/1069 220/230 |
| 8,505,174 | B2 * | 8/2013 | Fildan | A41F 1/002 24/303 |
| 8,914,951 | B2 * | 12/2014 | Gaudillere | A44B 11/266 24/303 |
| 9,307,808 | B1 * | 4/2016 | Lill | A44B 11/2584 |
| 9,635,919 | B2 * | 5/2017 | Fiedler | A45C 13/10 |
| 2009/0070970 | A1 * | 3/2009 | Lundh | A44B 11/2592 24/489 |
| 2012/0044031 | A1 * | 2/2012 | Ninomiya | H01F 7/0263 335/219 |
| 2015/0135486 | A1 * | 5/2015 | Fiedler | A44B 11/2584 24/303 |
| 2017/0172262 | A1 * | 6/2017 | Paik | A44B 11/2592 |

* cited by examiner

MAGNETIC BUCKLE

FIELD OF THE INVENTION

The present invention relates to a buckle, and more particularly, to a magnetic buckle, of which a male and a female buckle member can be quickly and magnetically engaged with each other without the need of aligning them in advance.

BACKGROUND OF THE INVENTION

Thanks to the constant improvements in the industrial technical field, various buckles with diversified and exquisite structures and functions have been constantly developed. Now, buckles with special designs can be found on a lot of different articles, such as garments, furniture, sporting goods, safety guards, handbags, etc.

Currently, there is a prior art fast-engaging and fast-release magnetic buckle 1 available in the market. Please refer to FIG. 1. The prior art magnetic buckle 1 includes a male buckle member 10 and a female buckle member 11. The male buckle member 10 includes a first buckle body 101 and a first magnetic attraction element 102 fitted on the first buckle body 101; and the first buckle member 101 includes an engaging body 103. On the other hand, the female buckle member 11 includes a second buckle body 111 and a second magnetic attraction element 112 fitted on the second buckle body 111; and the second buckle body 111 includes an engaging groove 113 formed on a lower half thereof. The engaging groove 113 has a stop opening 113*a* oriented in an x-axis direction and an engagement opening 113*b* oriented in a z-axis direction. The stop opening 113*a* defines a diametrical size smaller than that of the engaging body 103; and the engagement opening 113*b* defines a diametrical size larger than that of the engaging body 103.

FIG. 2 is an assembled sectional view showing the male buckle member 10 and a female buckle member 11 of the prior art magnetic buckle 1 of FIG. 1 in an engaged state. Please refer to FIGS. 1 and 2 at the same time. A mutual magnetic attraction of the first and the second magnetic attraction element 102, 112 enables the male buckle member 10 and the female buckle member 11 to move toward each other. However, since the engaging body 103 has a diametrical size larger than that of the stop opening 113*a*, it could not be engaged with the engaging groove 113 via the stop opening 113*a* of the female buckle member 11, and the male and the female buckle member 10, 11 are in a separated state, in which the male and the female buckle member 10, 11 can be freely released from each other at any time.

To set the engaging body 103 of the male buckle member 10 in the engaging groove 113 of the female buckle member 11 for the male and the female buckle member 10, 11 to be in the engaged state, a user has to move the engaging body 103 to a top of the engagement opening 113*b*. Otherwise, it is impossible for the engaging body 103 to engage with the engaging groove 113 simply via the mutual magnetic attraction of the first and the second magnetic attraction element 102, 112.

In view of the above disadvantage in the manner of engaging the male and the female buckle member of the prior art magnetic buckle 1 with each other, it is necessary to develop a magnetic buckle that enables fast engagement of a male and a female buckle member thereof.

SUMMARY OF THE INVENTION

A primary object of the present invention is to provide a magnetic buckle having two buckle bodies that respectively have a magnetic attraction element fitted thereon. When the two buckle bodies are in a separated state, a mutual magnetic attraction of the two magnetic attraction elements enables one of the two buckle bodies to move from one place to another and quickly magnetically engage with the other buckle body without the necessity of aligning them in advance or double-checking the engagement between them, so that the magnetic buckle is very convenient for use.

To achieve the above and other objects, the magnetic buckle according to the present invention includes a first buckle body, a second buckle body and a guide structure. The first buckle body has a first magnetic attraction element fitted thereon and includes a pair of first snap-fit sections and a first extended section, to which a first belt is coupled. The second buckle body has a second magnetic attraction element fitted thereon and includes a pair of second snap-fit sections and a second extended section, to which a second belt is coupled.

A mutual magnetic attraction between the first magnetic attraction element and the second magnetic attraction element causes the first buckle body to move along a coupling locus toward the second buckle body. The coupling locus includes an approaching path, within which the first buckle body is not in contact with the second buckle body, a contacting path, within which the first buckle body is brought to get in contact with the second buckle body, and a locating path, within which the first buckle body is brought to engage with the second buckle body.

According to a preferred embodiment of the present invention, the first extended section and the second extended section are located at two opposite sides of the locating path; and, the first buckle body moves longitudinally relative to the second buckle body within the approaching path, moves obliquely relative to the second buckle body within the contacting path, and moves laterally relative to the second buckle body within the locating path. More specifically, the first buckle body moving obliquely within the contacting path moves laterally and longitudinally at the same time. However, a direction of the lateral movement of the first buckle body within the locating path is opposite to a direction of the lateral movement of the first buckle body within the contacting path.

The first snap-fit sections respectively include an extended arm portion formed on the first buckle body and a protrusion portion formed on the extended arm portion, and the second snap-fit sections respectively include a groove sunken from the second buckle body. The grooves respectively include a movement space adapted to receive the extended arm portion and the protrusion portion therein at the same time and a snap-fit space adapted to receive only the protrusion portion therein.

The second buckle body further includes a release opening formed on each of the second snap-fit sections. The first buckle body is movable along a releasing path to separate from the second buckle body via the release openings. The releasing path defines a moving direction that is perpendicular to a moving direction defined by the locating path.

When the first buckle body moves along the coupling locus, a relative position of the first and the second magnetic attraction element is changed from an aligned state, in which the first and the second magnetic attraction element completely overlap each other, to a staggered state, in which the first and the second magnetic attraction element partially overlap each other. More specifically, the first and the second magnetic attraction element are continuously maintained in the staggered state when the first buckle body is moving along the locating path.

The guide structure is formed on between the first and the second buckle body. The mutual magnetic attraction of the first and the second magnetic attraction element and the guide structure together enable the first buckle body to move in different directions when sequentially moving along the approaching path, the contacting path and the locating path.

The guide structure includes a pair of first guide surfaces formed on the first snap-fit sections and a pair of second guide surfaces formed on the second snap-fit sections. The first guide surfaces and the second guide surfaces are brought to contact with one another when the first buckle body is moving along the contacting path; and the first and the second guide surfaces are inclined in a direction parallel to an extending direction of the contacting path of the coupling locus.

The magnetic buckle of the present invention is characterized in that the guide structure and the mutual magnetic attraction of the first and the second magnetic attraction element together enable the first buckle body to move in different directions when sequentially moving along the approaching path, the contacting path and the locating path. With these arrangements, the first buckle body movable from one place to another under the magnetic attraction of the first and second magnetic attraction elements can quickly move into the locating path to be magnetically engaged with the second buckle body without the necessity of aligning them in advance or double-checking the engagement between them, making the magnetic buckle convenient for use.

BRIEF DESCRIPTION OF THE DRAWINGS

The structure and the technical means adopted by the present invention to achieve the above and other objects can be best understood by referring to the following detailed description of the preferred embodiment and the accompanying drawings, wherein.

DETAILED DESCRIPTION OF THE PREFERRED EMBODIMENTS

The present invention will now be described with a preferred embodiment thereof and by referring to the accompanying drawings.

Figure 1:
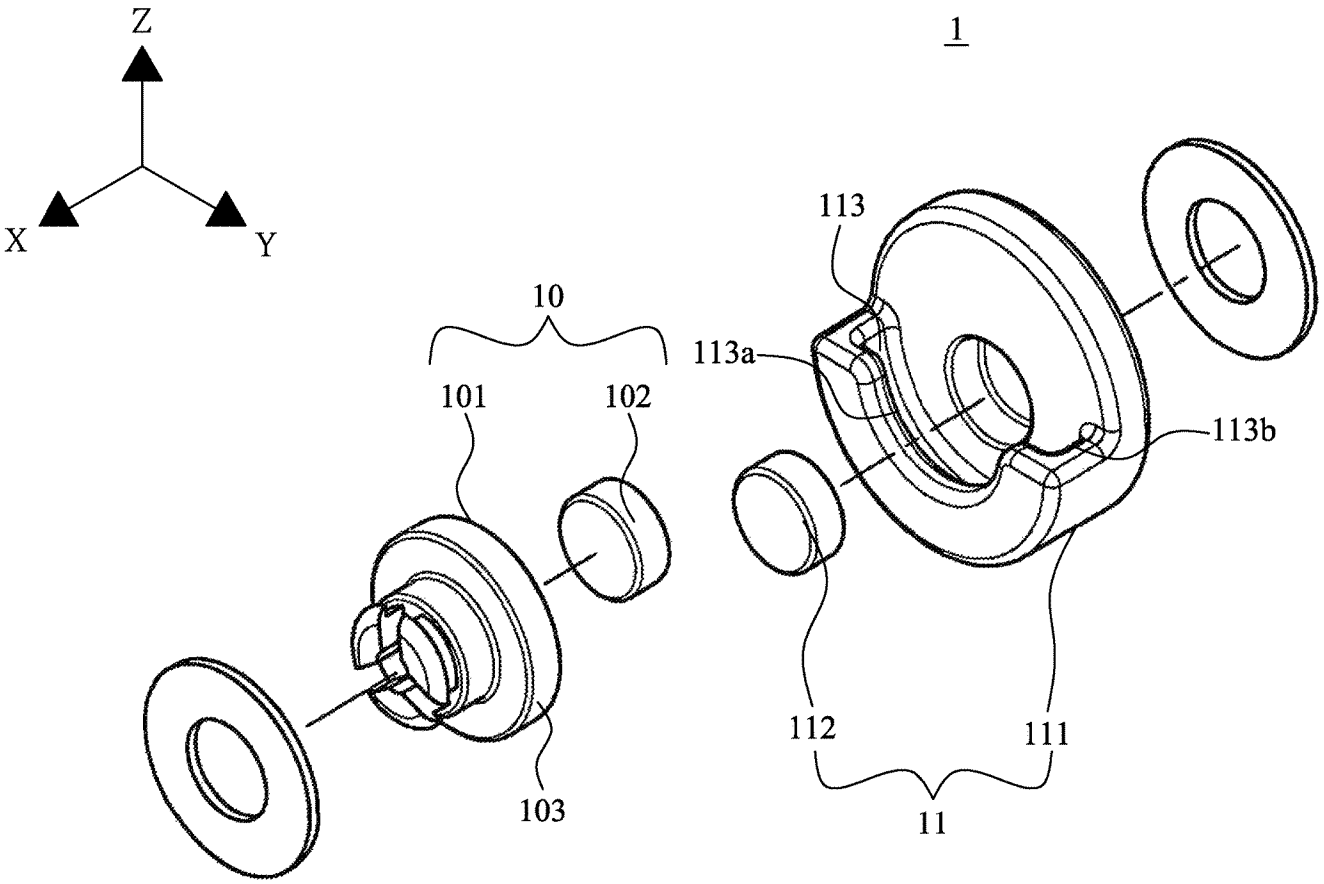
FIG. 1 (Prior Art)
FIG. 1 is an exploded perspective view of a prior art magnetic buckle.
Figure 2:
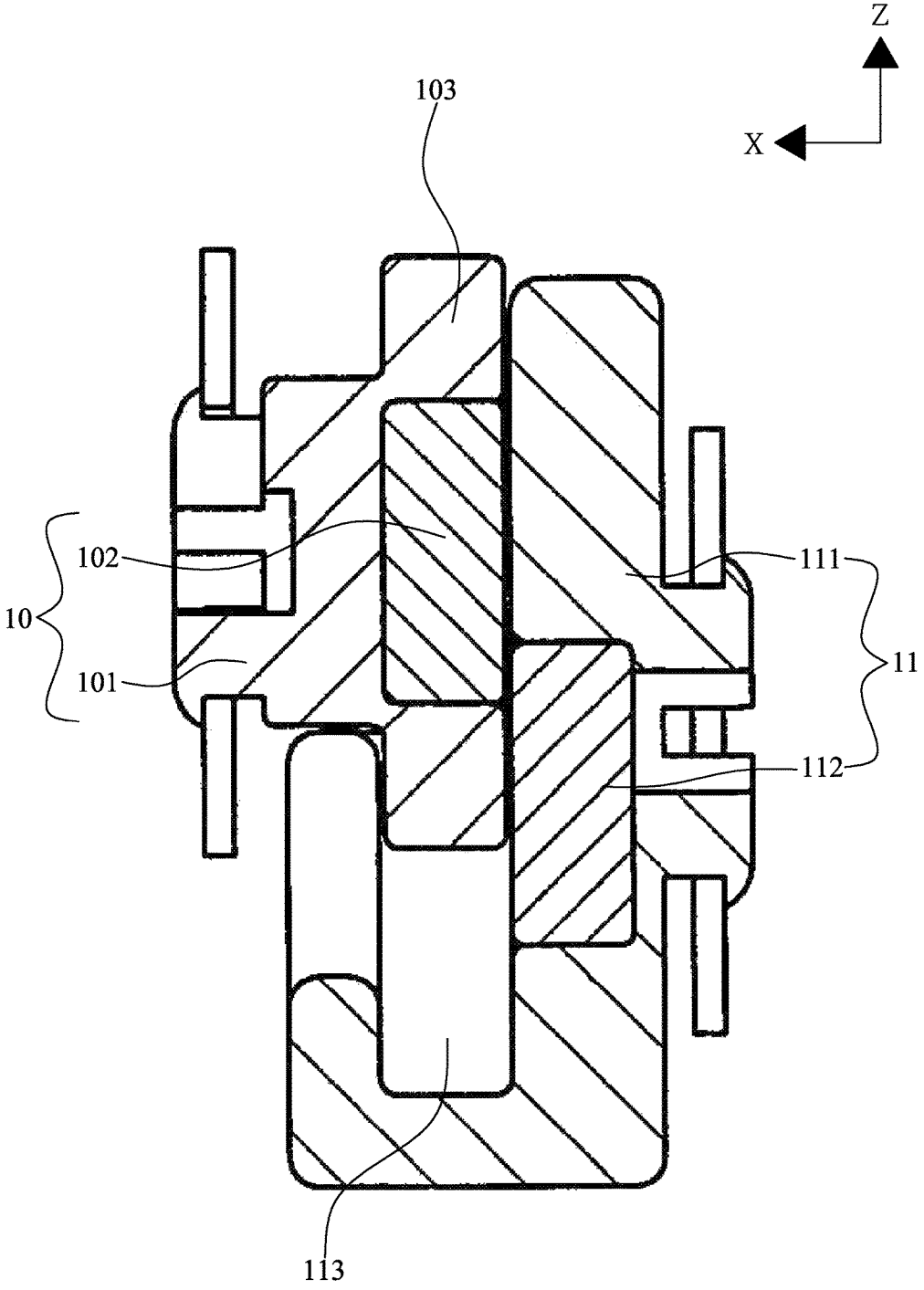
FIG. 2 (Prior Art)
FIG. 2 shows a male buckle member and a female buckle member of the prior art magnetic buckle of FIG. 1 in an engaged state.
Figure 3A:
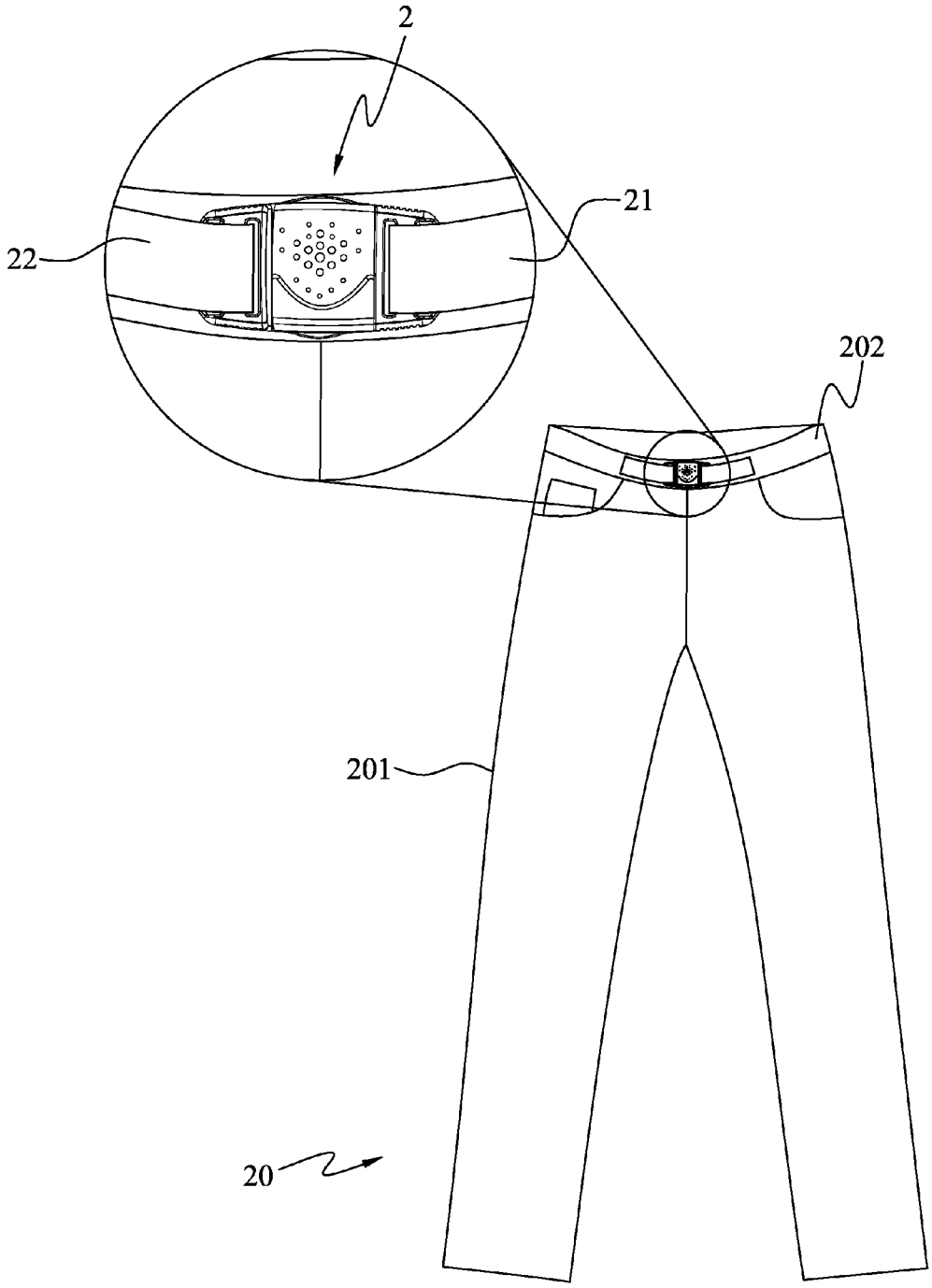
FIG. 3A shows a magnetic buckle according to the present invention is used on a pair of trousers.
Figure 3B:
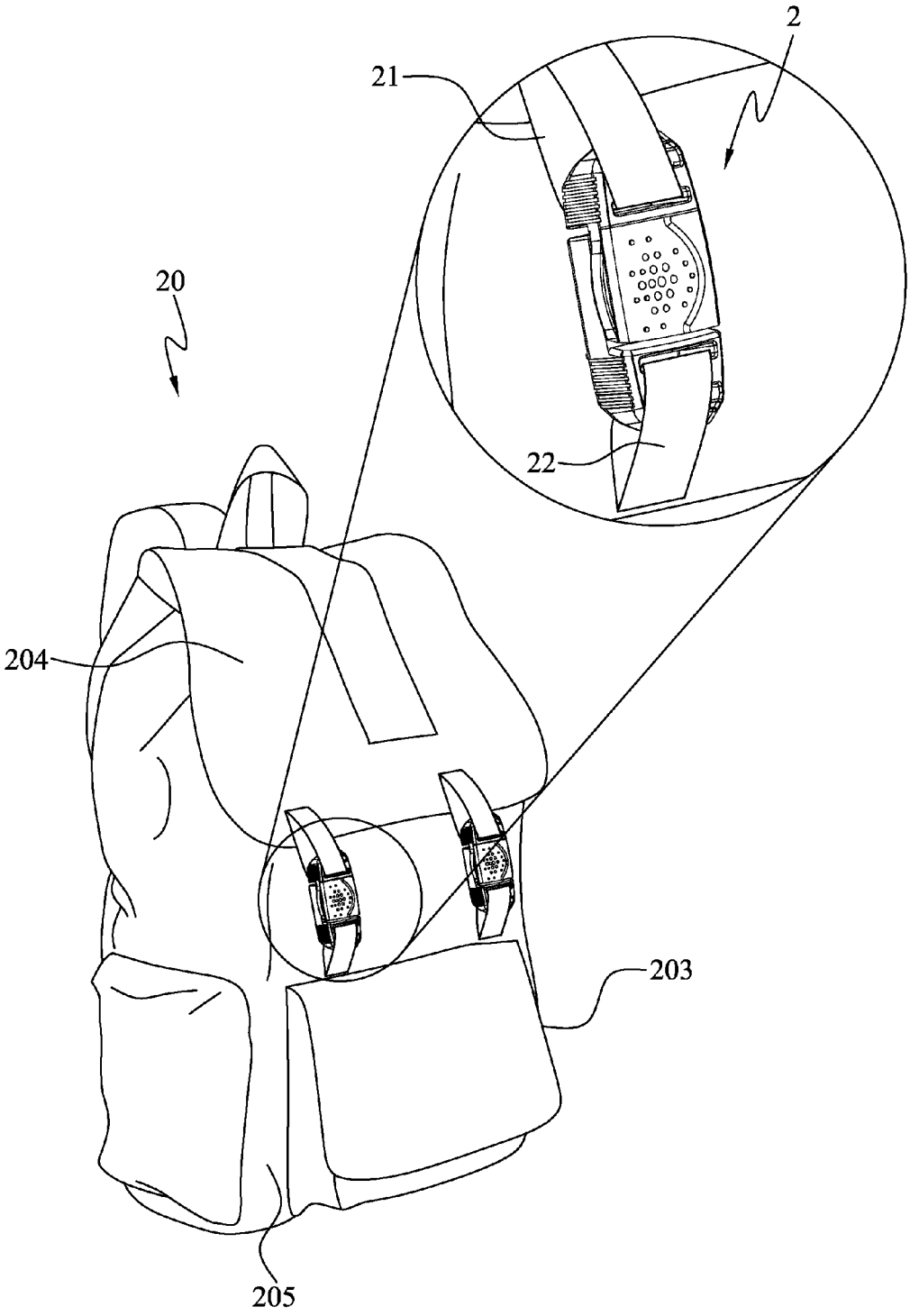
FIG. 3B shows the magnetic buckle according to the present invention is used on a backpack.

Please refer to FIG. 3A. The present invention relates to a magnetic buckle 2, which is mainly used on an object 20 having two parts, such as a first belt 21 and a second belt 22, to be connected to one another via a buckle. In FIG. 3A, the object 20 is a pair of trousers 201; and the first and the second belt 21, 22 are provided on a waistband 202 of the pair of trousers 201. However, it is understood the object 20 is not limited to a pair of trousers 201 but can be other things. For example, as shown in FIG. 3B, the object 20 is a backpack 203 with the first belt 21 provided on a top lid 204 of the backpack 203 and the second belt 22 provided on a main bag 205 of the backpack 203.

Figure 4:
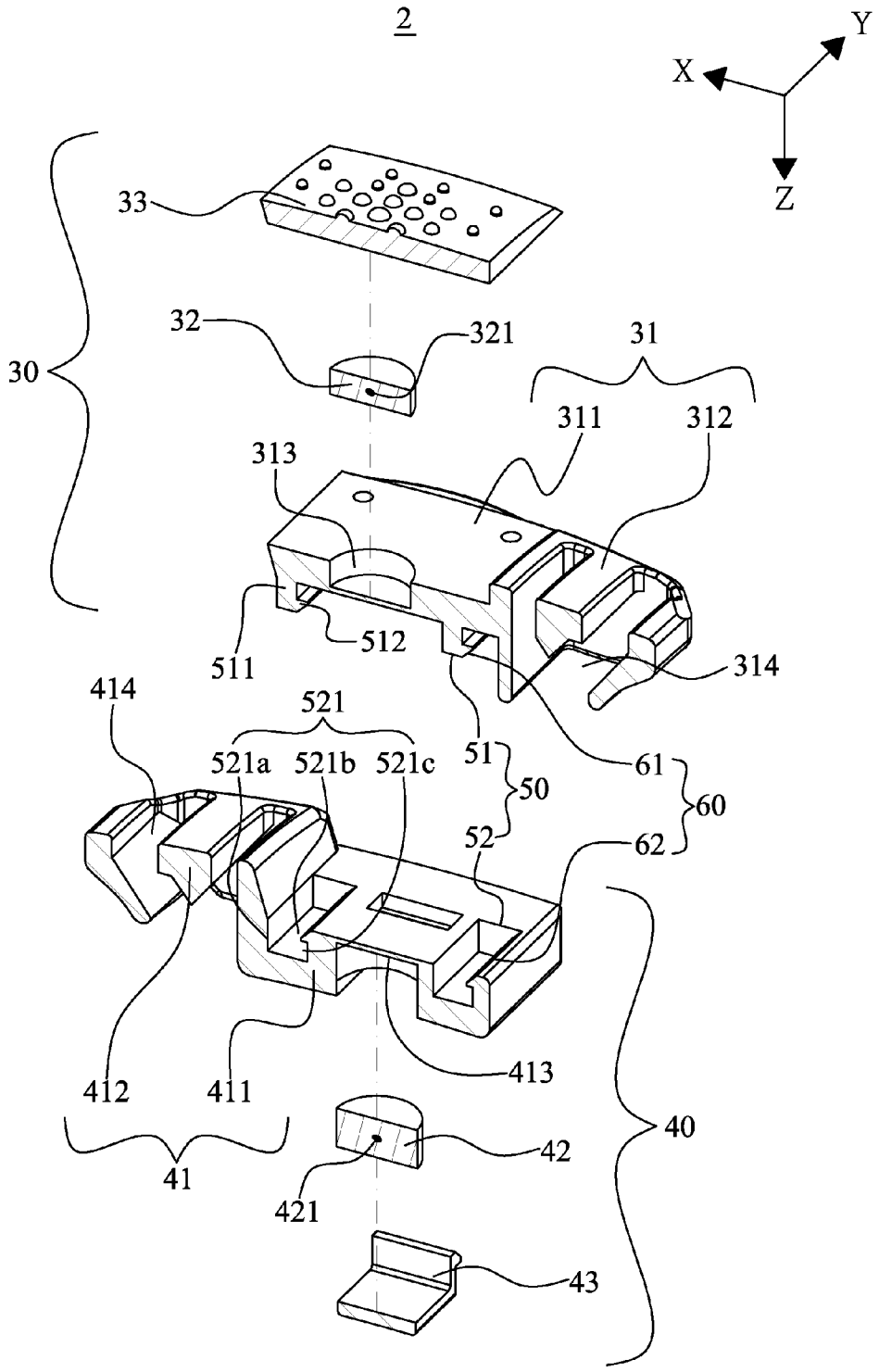
FIG. 4 is an exploded perspective view of the magnetic buckle according to a preferred embodiment of the present invention.

FIG. 4 is an exploded perspective view of the magnetic buckle 2 according to a preferred embodiment of the present invention. As shown, the magnetic buckle 2 includes a male buckle member 30, a female buckle member 40, a snap-fit unit 50, and a guide structure 60.

The male buckle member 30 includes a first buckle body 31, a first magnetic attraction element 32 and a first cover plate 33. The first buckle body 31 includes a first engagement section 311 formed at one end thereof and a first extended section 312 formed at the other end thereof. The first extended section 312 has an overall thickness larger than that of the first engagement section 311. The first engagement section 311 is provided with a first receiving space 313, which is an open-top recess formed on a top of the first engagement section 311 to orient in a z-axis direction. The first extended section 312 defines a first coupling space 314, to which a first belt 21 such as that shown in FIG. 3A is coupled. The first magnetic attraction element 32 is fitted in the first receiving space 313. The first cover plate 33 is assembled to the top of the first engagement section 311 to cover and close the first receiving space 313, such that the first engagement section 311 and the first cover plate 33 together enclose the first magnetic attraction element 32 in between them, preventing the first magnetic attraction element 32 from falling out of the first receiving space 313.

The female buckle member 40 includes a second buckle body 41, a second magnetic attraction element 42 and a second cover plate 43. The second buckle body 41 includes a second engagement section 411 formed at one end thereof and a second extended section 412 formed at the other end thereof. The second extended section 412 has an overall thickness larger than that of the second engagement section 411. The second engagement section 411 is provided with a second receiving space 413, which is an open-bottom recess formed on a bottom of the second engagement section 411 to orient in the z-axis direction. The second extended section 412 defines a second coupling space 414, to which a second belt 22 such as that shown in FIG. 3A is coupled. The second magnetic attraction element 42 is fitted in the second receiving space 413. The second cover plate 43 is assembled to the bottom of the second engagement section 411 to cover and close the second receiving space 413, such that the second engagement section 411 and the second cover plate 43 together enclose the second magnetic attraction element 42 in between them, preventing the second magnetic attraction element 42 from falling out of the second receiving space 413.

The snap-fit unit 50 is located between the first buckle body 31 and the second buckle body 41, and includes a pair of spaced first snap-fit sections 51 and a pair of spaced second snap-fit sections 52. The first snap-fit sections 51 are formed on a bottom of the first engagement section 311 of the first buckle body 31, and the second snap-fit sections 52 are formed on a top of the second engagement section 411 of the second buckle body 41.

As shown, the first snap-fit sections 51 respectively include an extended arm portion 511 formed on the bottom of the first engagement section 311 and a protrusion portion 512 extended from a free end of the extended arm portion 511 in an x-axis direction, such that the first snap-fit sections 51 respectively have an L-shaped configuration. The second snap-fit sections 52 respectively include a groove 521 sunken from a top of the second engagement section 411 and extended in a y-axis direction. The grooves 521 respectively include a release opening 521*a* oriented in a direction parallel with the y-axis direction, a movement space 521*b* communicable with a space above the second engagement section 411, and a snap-fit space 521*c* communicable with the movement space 521*b*. The first snap-fit sections 51 of the snap-fit unit 50 can be selectively coupled to or released from the second snap-fit sections 52 of the snap-fit unit 50.

Figure 5A:
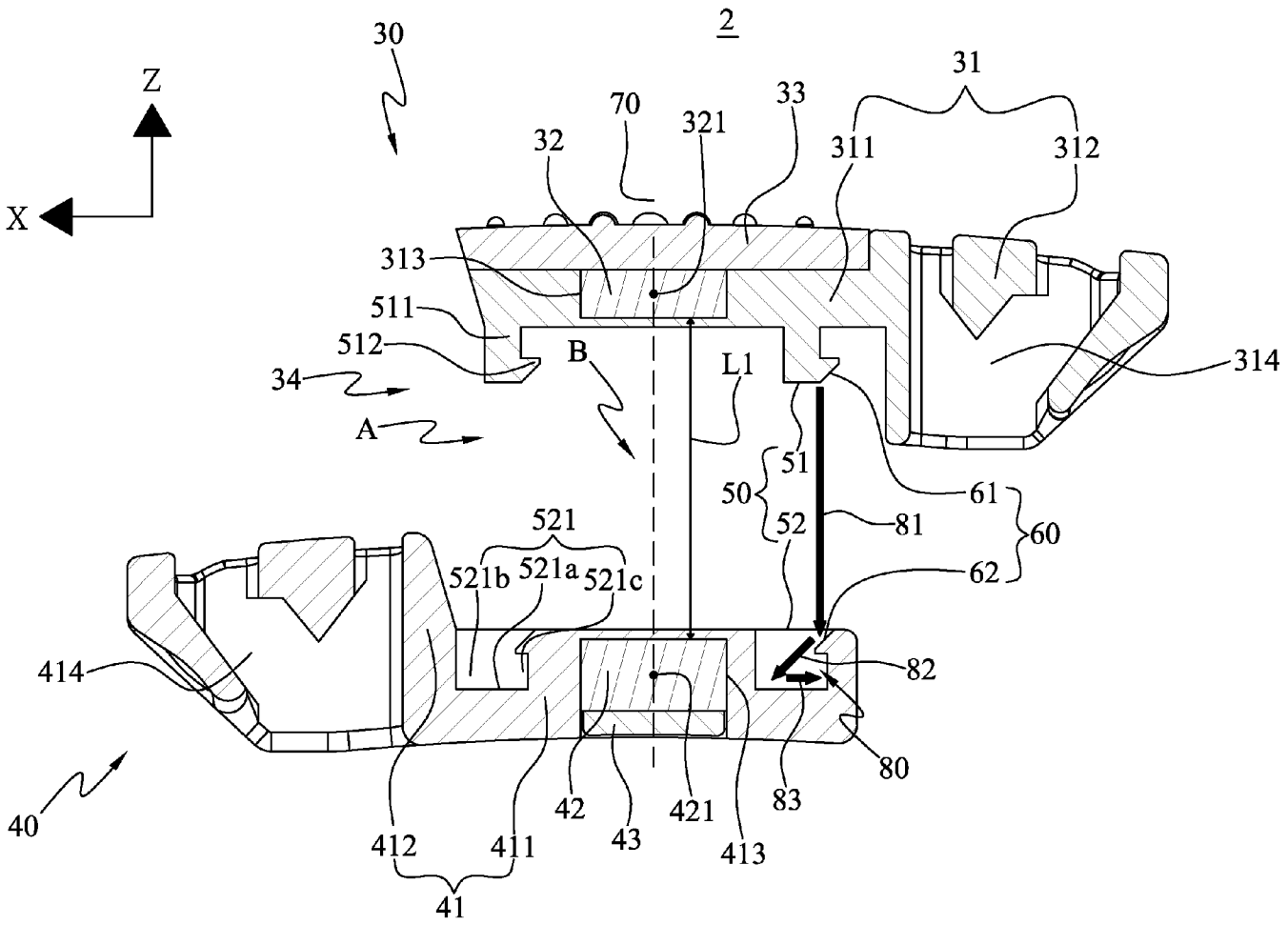
FIG. 5A is a sectional view showing a male buckle member of the magnetic buckle of the present invention is in a SEPARATED position, in which the male buckle member is separated from a female buckle member of the magnetic buckle.
Figure 5B:
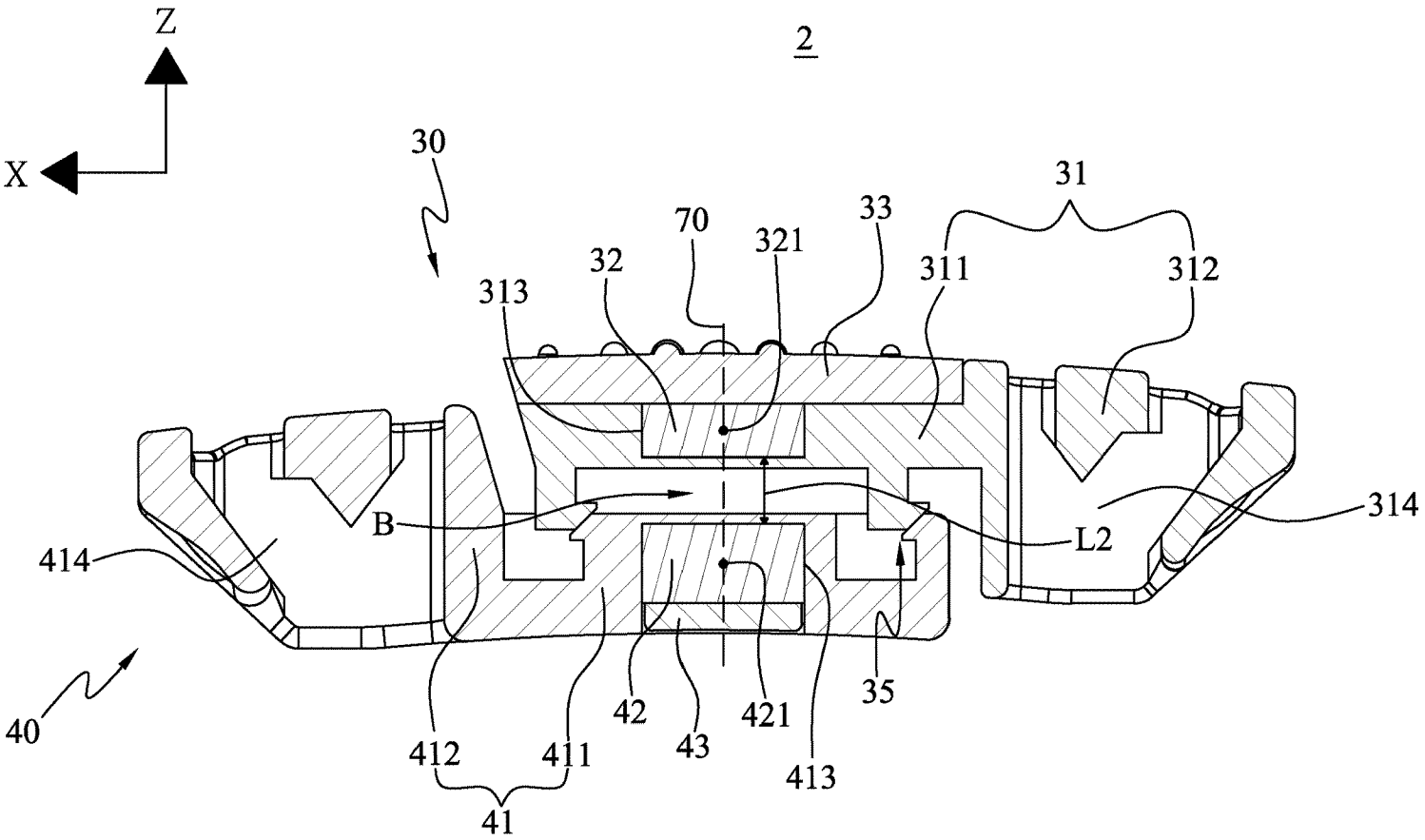
FIG. 5B is a sectional view showing the male buckle member of the magnetic buckle of the present invention is in a CONTACTED position, in which the male buckle member is in contact with the female buckle member.
Figure 5C:
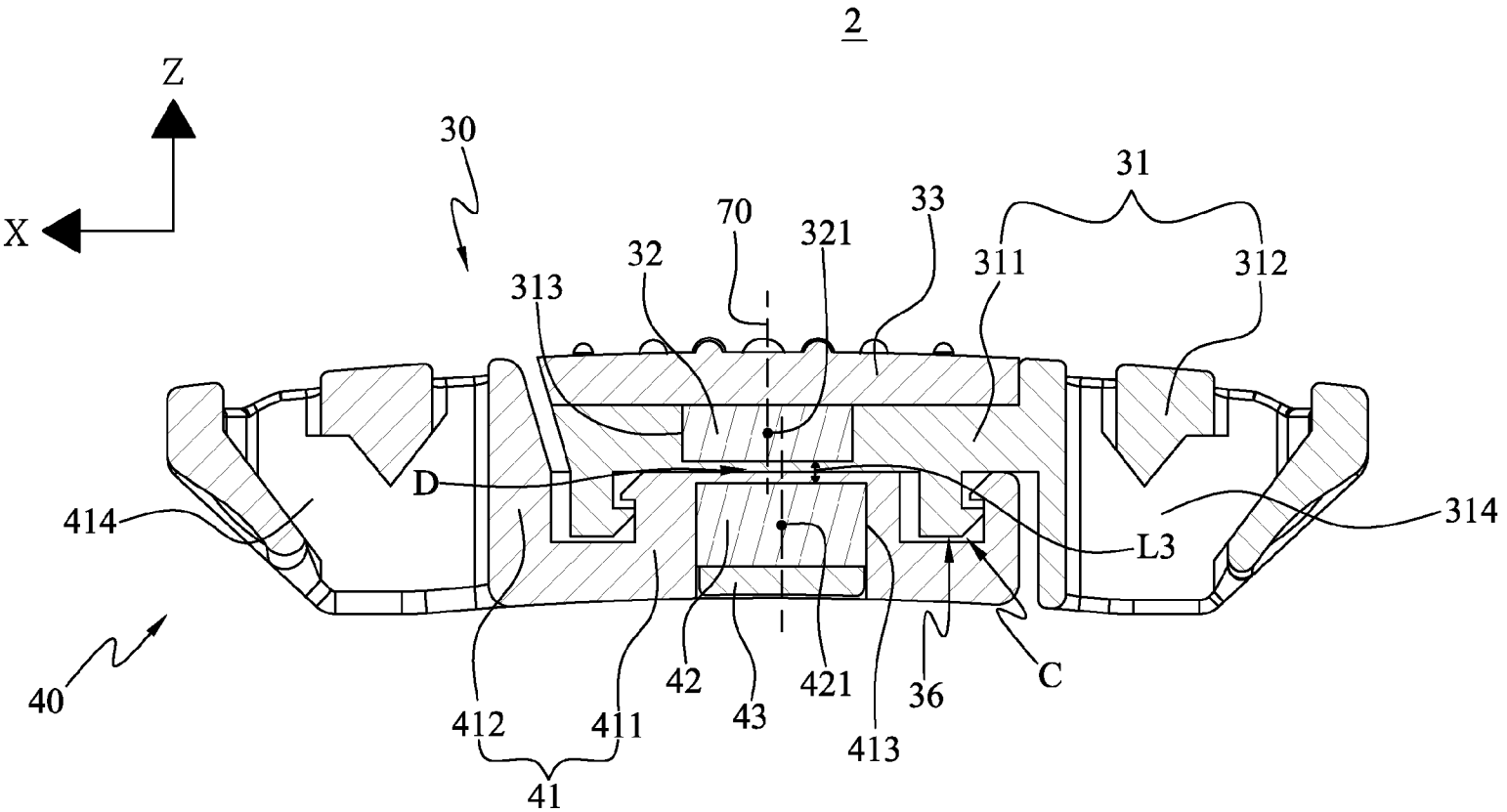
FIG. 5C is a sectional view showing the male buckle member of the magnetic buckle of the present invention is in an ENGAGED position, in which the male buckle member is engaged with the female buckle member.

Please refer to FIGS. 5A to 5C. When the first snap-fit sections 51 and the second snap-fit sections 52 are in a separated state A, as shown in FIG. 5A, the first snap-fit sections 51 are released from the second snap-fit sections 52, the male buckle member 30 is located at a SEPARATED position 34 and not in contact with the female buckle member 40, and a first distance L1 is existing between a bottom of the first magnetic attraction element 32 and a top of the second magnetic attraction element 42. In the illustrated embodiment, when the male buckle member 30 is located at the SEPARATED position 34, the first magnetic attraction element 32 and the second magnetic attraction element 42 are in an aligned state B relative to each other, in which the first and the second magnetic attraction element 32, 42 completely overlap one another. And, when the first and the second magnetic attraction element 32, 42 are in the aligned state B, a center of gravity 321 of the first magnetic attraction element 32 and a center of gravity 421 of the second magnetic attraction element 42 fall on the same one vertical line 70, which is extended in the z-axis direction and perpendicular to both of the first and the second magnetic attraction element 32, 42.

Due to the magnetic attraction of the first and the second magnetic attraction element 32, 42 to each other, the male buckle member 30 is brought to move from the SEPARATED position 34 along a coupling locus 80 to a CONTACTED position 35 and an ENGAGED position 36 sequentially. In the CONTACTED position 35, the first snap-fit sections 51 are in contact with the second snap-fit sections 52, as shown in FIG. 5B; and, in the ENGAGED position 36, the first snap-fit sections 51 are engaged with the second snap-fit sections 52, as shown in FIG. 5C. More specifically, the coupling locus 80 includes an approaching path 81, within which the first snap-fit sections 51 are not in contact with the second snap-fit sections 52; a contacting path 82, within which the first snap-fit sections 51 are brought to contact with the second snap-fit sections 52; and a locating path 83, within which the first snap-fit sections 51 are brought to engage with the second snap-fit sections 52 eventually. As can be found in FIG. 5A, the approaching path 81 is extended from the SEPARATED position 34 to the CONTACTED position 35, and the contacting path 82 and the locating path 83 are extended from the CONTACTED position 35 to the ENGAGED position 36.

In the illustrated embodiment, when the male buckle member 30 moves along the approaching path 81 to finally arrive at the CONTACTED position 35, the first magnetic attraction element 32 and the second magnetic attraction element 42 are still maintained in the aligned state B and a second distance L2 shorter than the first distance L1 is now existing between the bottom of the first magnetic attraction element 32 and the top of the second magnetic attraction element 42. Further, as shown in FIG. 5C, when the male buckle member 30 moves along the contacting path 82 and the locating path 83 to finally move into the ENGAGED position 36, the first snap-fit sections 51 and the second snap-fit sections 52 are in a snap-fit state C, in which the first snap-fit sections 51 are engaged with the second snap-fit sections 52 and a third distance L3 shorter than the second distance L2 is existing between the bottom of the first magnetic attraction element 32 and the top of the second magnetic attraction element 42. As shown, when the male buckle member 30 is located at the ENGAGED position 36, the protrusion portions 512 of the first snap-fit sections 51 are located in the snap-fit spaces 521*c* of the grooves 521 and the extended arm portions 511 of the first snap-fit sections 51 are located in the movement spaces 521*b* without contacting with wall surfaces of the movement spaces 521*b*.

However, as can be seen in FIG. 5C, when the male buckle member 30 is located at the ENGAGED position 36, the first magnetic attraction element 32 and the second magnetic attraction element 42 are in a staggered state D relative to each other, in which the first magnetic attraction element 32 and the second magnetic attraction element 42 partially overlap each other. Also, when the first magnetic attraction element 32 and the second magnetic attraction element 42 are in the staggered state D, the center of gravity 321 of the first magnetic attraction element 32 and the center of gravity 421 of the second magnetic attraction element 42 fall on two different vertical lines 70, and the first extended section 312 of the first buckle body 31 and the second extended section 412 of the second buckle body 41 are located at two opposite sides of the locating path 83.

Please refer to FIG. 4 again. The guide structure 60 is formed on the snap-fit unit 50. As shown, the guide structure 60 includes a pair of first guide surfaces 61 and a pair of second guide surfaces 62. The first and the second guide surfaces 61, 62 are bevel surfaces inclined in a direction parallel to an extending direction of the contacting path 82 of the coupling locus 80, as can be seen in FIG. 5A. Wherein, the first guide surfaces 61 are formed on the first snap-fit sections 51 at their respective one lateral outer surface, and the second guide surfaces 62 are formed on the second snap-fit sections 52 at their respective one lateral outer surface.

Figure 5D:
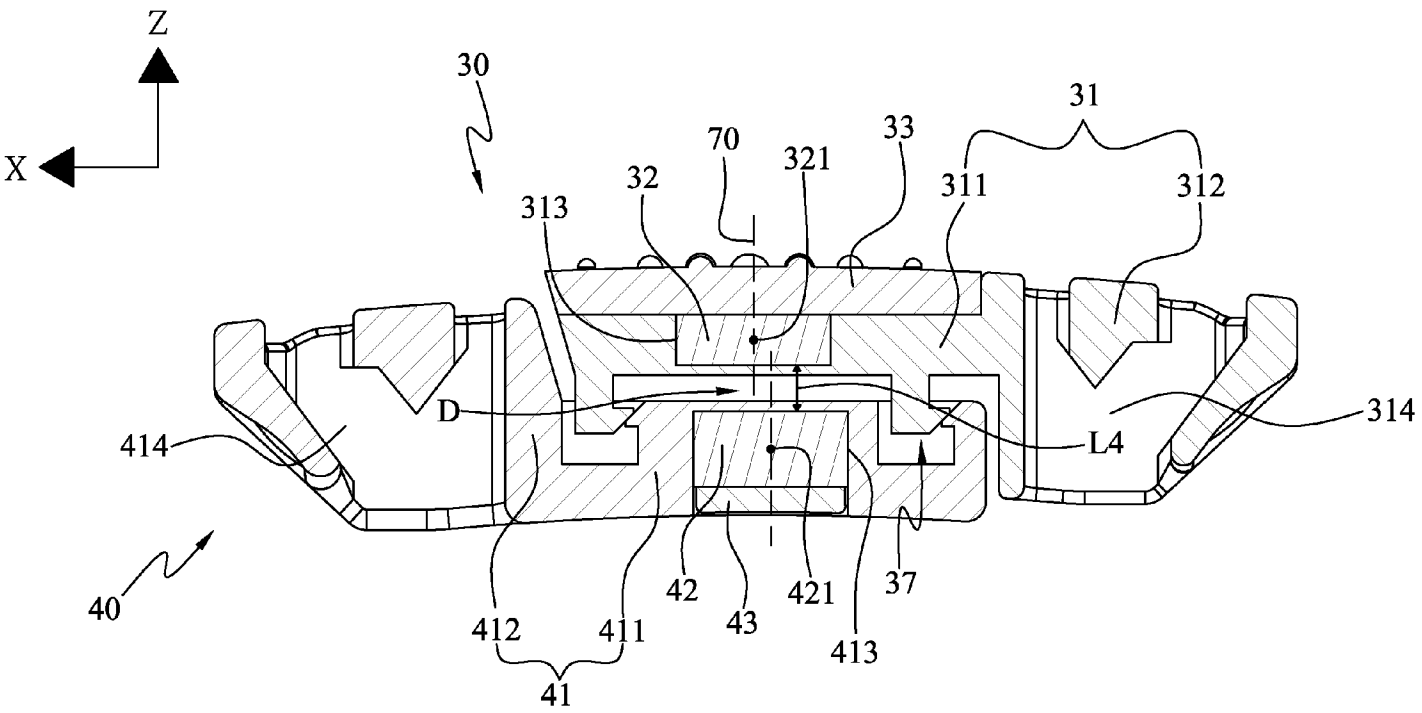
FIG. 5D is a sectional view showing the male buckle member of the magnetic buckle of the present invention is in a STAGGERED position, in which the male buckle member is in disalignment with the female buckle member.

Please refer to FIGS. 5A and 5D. The mutual magnetic attraction of the first and the second magnetic attraction element 32, 42 and the guide structure 60 together enable the first buckle body 31 of the male buckle member 30 to move in different directions when sequentially moving along the approaching path 81, the contacting path 82 and the locating path 83. Therefore, in the course of moving from the CONTACTED position 35 to the ENGAGED position 36, the male buckle member 30 first moves from the CONTACTED position 35 along the contacting path 82 to a STAGGERED position 37 and then moves from the STAGGERED position 37 along the locating path 83 to the ENGAGED position 36. When the male buckle member 30 is located at the STAGGERED position 37, there is a fourth distance L4 existing between the bottom of the first magnetic attraction element 32 and the top of the second magnetic attraction element 42, as shown in FIG. 5D.

As shown in FIG. 5D, the fourth distance L4 has a length falling between those of the second distance L2 and the third distance L3. In other words, the second distance L2 is larger than the fourth distance L4 while the third distance L3 is smaller than the fourth distance L4. When the male buckle member 30 is located at the STAGGERED position 37, the first magnetic attraction element 32 partially overlaps the second magnetic attraction element 42, and the first and the second magnetic attraction element 32, 42 are in the staggered state D. Meanwhile, the extended arm portions 511 and the protrusion portions 512 of the first snap-fit sections 51 all are located in the movement spaces 521*b* of the grooves 521.

Figure 6A:
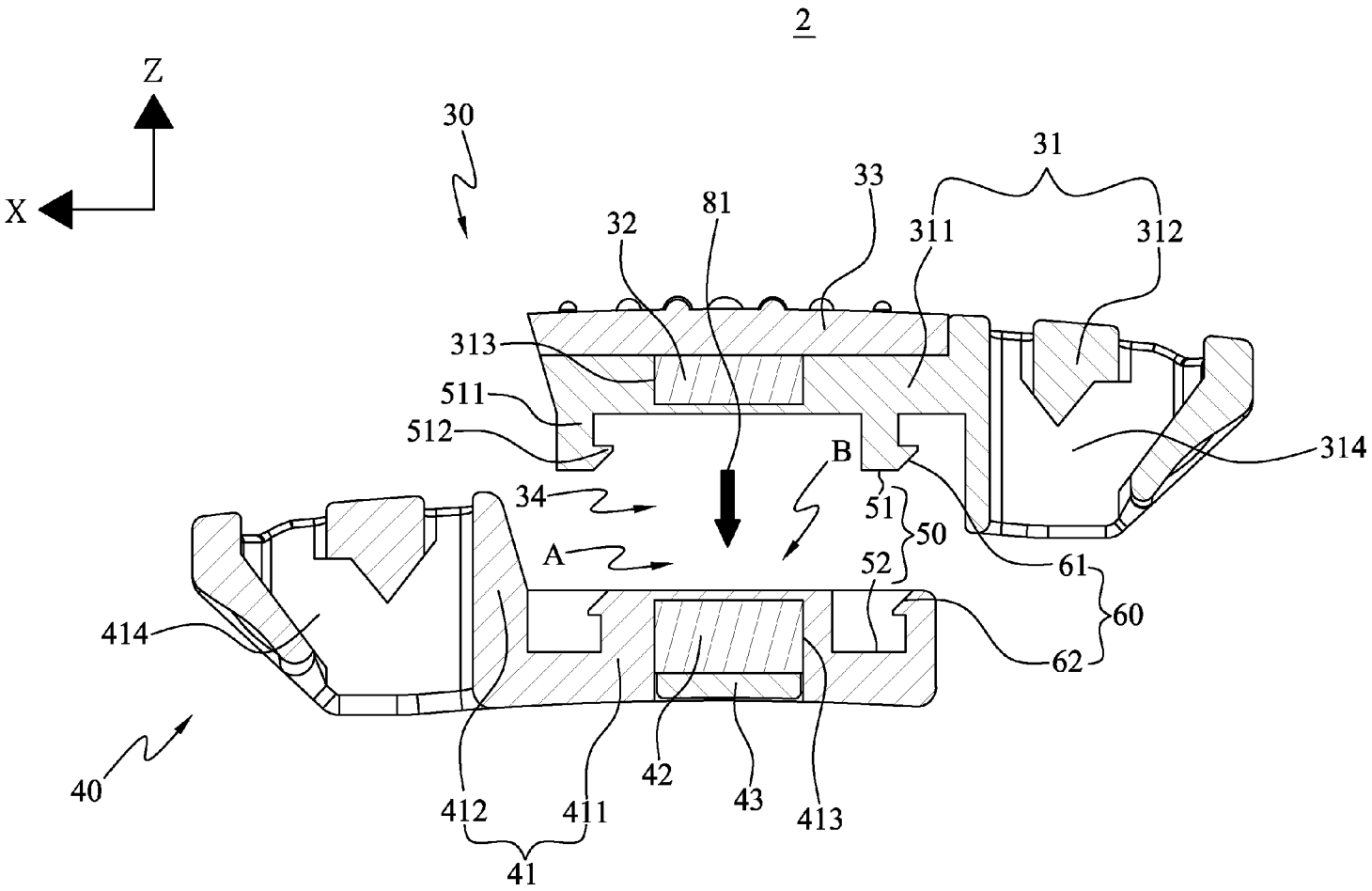
FIGS. 6A to 6C are sectional views showing how two first snap-fit sections on the male buckle member and two second snap-fit sections on the female buckle member of the magnetic buckle of the present invention are changed from a mutually separated state into a mutually snap-fit state.

Please refer to FIG. 6A. When the first snap-fit sections 51 and the second snap-fit sections 52 are to be changed from the separated state A to the snap-fit state C, first move the male buckle member 30 to a location above the female buckle member 40, so that the male buckle member 30 is located at the SEPARATED position 34 and the first and the second magnetic attraction element 32, 42 are in the aligned state B. Thereafter, the first and the second magnetic attraction element 32, 42 magnetically attract each other, bringing the male buckle member 30 to move longitudinally along the approaching path 81 of the coupling locus 80 in the z-axis direction until the male buckle member 30 is located at the CONTACTED position 35. When the male buckle member 30 is located at the CONTACTED position 35 (see FIG. 5B), the first and the second guide surfaces 61, 62 of the guide structure 60 are in contact with one another.

Figure 6B:
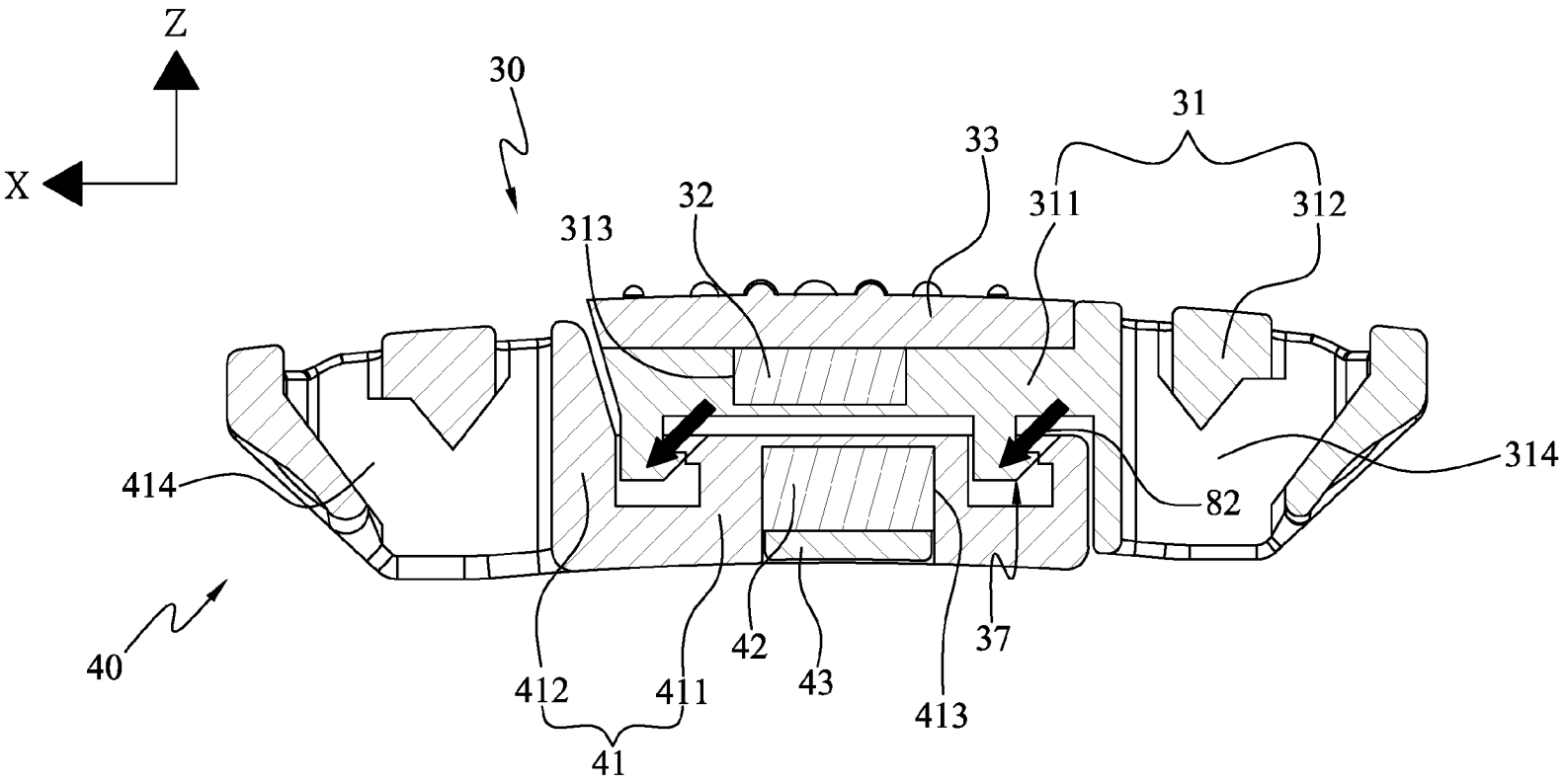

Please refer to FIG. 6B. When the male buckle member 30 is located at the CONTACTED position 35, the mutual magnetic attraction of the first and the second magnetic attraction element 32, 42 and the contact of the first guide surfaces 61 with the second guide surfaces 62 enable the male buckle member 30 to move along the contacting path 82 of the coupling locus 80 in an oblique direction until the male buckle member 30 is moved to the STAGGERED position 37. At this point, the first and the second magnetic attraction element 32, 42 are changed from the aligned state B to the staggered state D. In the illustrated embodiment, when the male buckle member 30 moves obliquely, it moves in the x-axis and the z-axis direction at the same time, causing the protrusion portions 512 of the first snap-fit sections 51 to move into the movement spaces 521*b*, as shown in FIG. 5C. Further, when the first buckle body 31 of the male buckle member 30 is moving along the contacting path 82, the first and the second guide surfaces 61, 62 are in contact with one another.

Figure 6C:
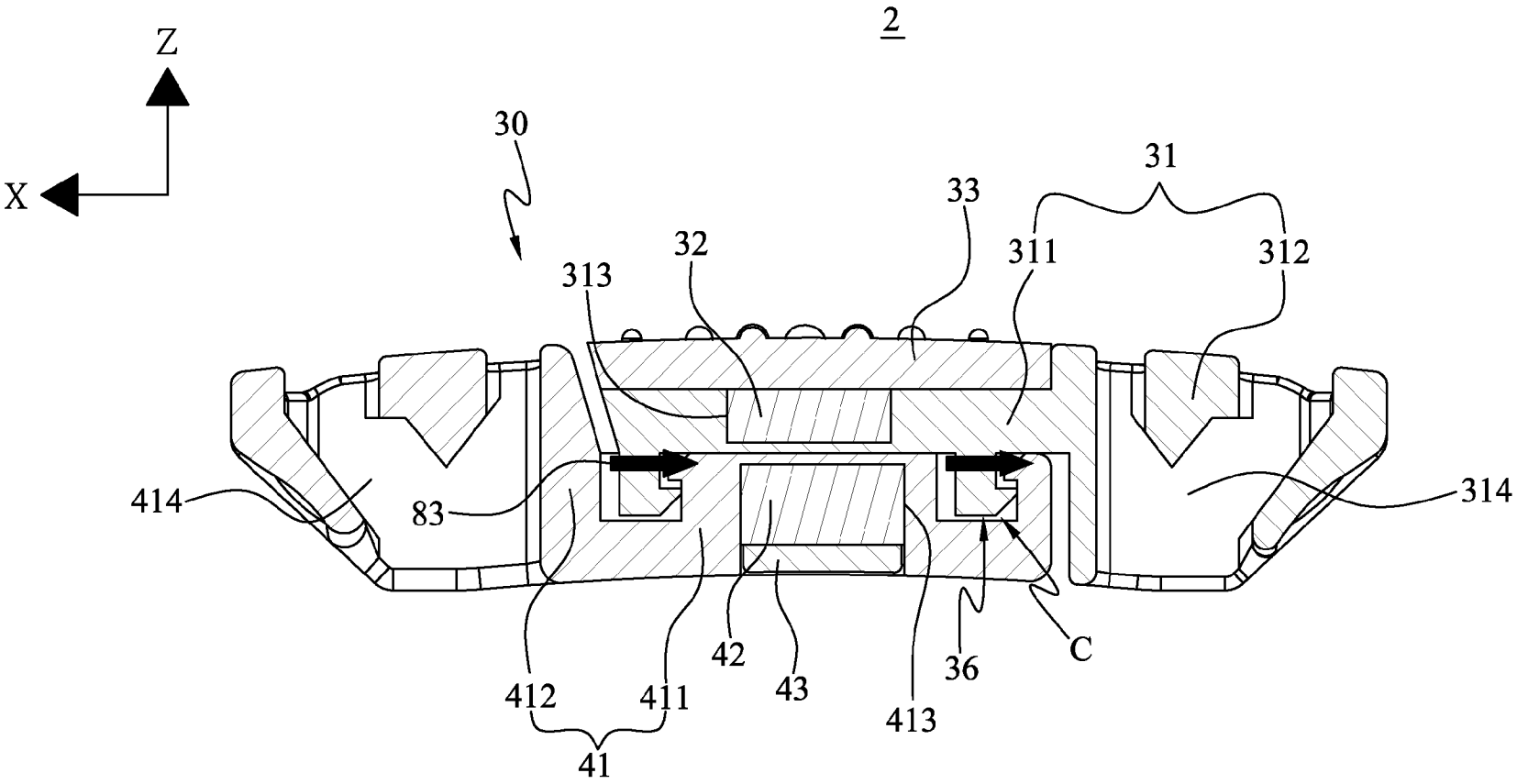

Please refer to FIG. 6C. When the male buckle member 30 is moved along the contacting path 82 of the coupling locus 80 to the STAGGERED position 37 and the first guide surfaces 61 and the second guide surfaces 62 of the guide structure 60 can no longer contact with one another, the mutual magnetic attraction of the first and the second magnetic attraction element 32, 42 brings the male buckle member 30 to laterally move along the locating path 83 of the coupling locus 80 in the x-axis direction. At this point, the first and the second magnetic attraction element 32, 42 are still in the staggered state D and the first snap-fit sections 51 and the second snap-fit sections 52 have changed from the separated state A to the snap-fit state C. As shown, the x-axis direction of the lateral movement of the male buckle member 30 along the locating path 83 is opposite to the x-axis direction of the lateral movement of the male buckle member 30 when the latter obliquely moves along the contacting path 82. Further, when the male buckle member 30 is moved from the STAGGERED position 37 to the ENGAGED position 36, the protrusion portions 512 of first snap-fit sections 51 are horizontally moved in the x-axis direction into the snap-fit spaces 521*c*.

When the male buckle member 30 is located at the ENGAGED position 36, the first and the second magnetic attraction element 32, 42 are still maintained in the staggered state D, allowing the protrusion portions 512 of the first snap-fit sections 51 to keep locating in the snap-fit spaces 521*c* of the grooves 52 and preventing the male buckle member 30 from moving from the ENGAGED position 36 in the z-axis direction to the SEPARATED position 34.

It is understood the above description that the first and the second magnetic attraction element 32, 42 are maintained in the staggered state D when the male buckle member 30 is moved from the STAGGERED position 37 to the ENGAGED position 36 is only illustrative. In other feasible embodiments, the first and the second magnetic attraction element 32, 42 can be otherwise changed from the staggered state D to the aligned state B when the male buckle member 30 is moved from the STAGGERED position 37 to the ENGAGED position 36.

In addition, when the first and the second snap-fit sections 51, 52 are in the snap-fit state C, the first belt 21 and the second belt 22 provided on the waistband 202 of the pair of trousers 201 as shown in FIG. 3A can tighten the waistband 202 to prevent the pair of trousers 201 from slipping off a wearer's waist. Or, when the first and the second snap-fit sections 51, 52 are in the snap-fit state C, as shown in FIG. 6C, the magnetic buckle 2 can hold the top lid 204 of the backpack 203 in a closed position and accordingly, prevent articles in the main bag 205 from falling out of the backpack 203.

Figure 6D:
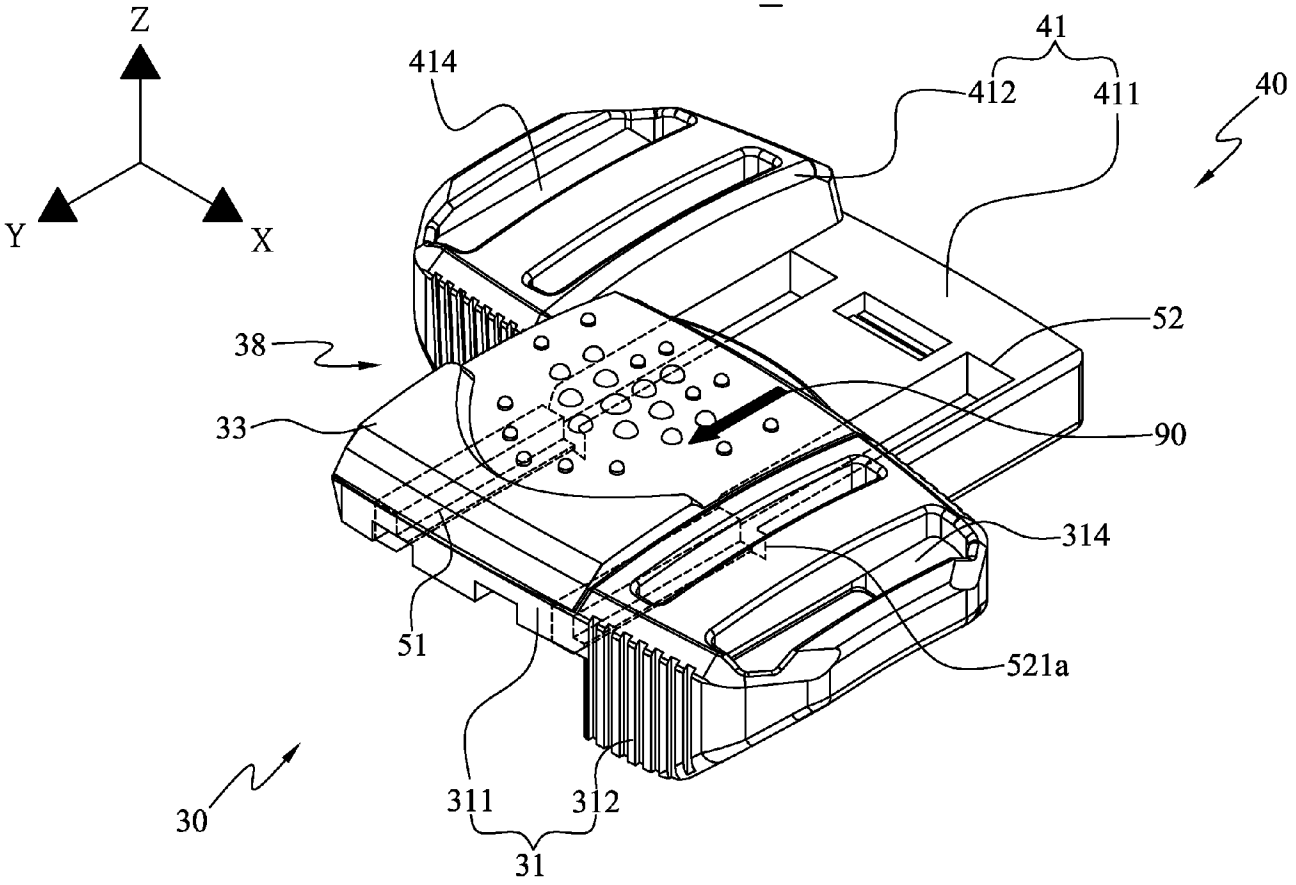
FIG. 6D is a perspective view showing how the male buckle member of the magnetic buckle of the present invention is released from the female buckle member.

Please refer to FIG. 6D. When the first and the second snap-fit sections 51, 52 are in the snap-fit state C, the male buckle member 30 can be moved from the ENGAGED position 36 along a releasing path 90 in the y-axis direction to a DISENGAGED position 38, in which the protrusion portions 512 of the first snap-fit sections 51 are separated from the snap-fit spaces 521*c* of the second snap-fit sections 52, allowing the male buckle member 30 and the female buckle member 40 to separate from each other. It is noted the releasing path 90 defines a moving direction that is perpendicular to that of the locating path 83.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A magnetic buckle, comprising:

a first buckle body having a first magnetic attraction element fitted thereon and a pair of first snap-fit sections formed thereon;

a second buckle body having a second magnetic attraction element fitted thereon and a pair of second snap-fit sections formed thereon adapted to detachably engage with the first snap-fit sections;

a mutual magnetic attraction between the first magnetic attraction element and the second magnetic attraction element causing the first buckle body to move along a coupling locus toward the second buckle body;

the coupling locus including an approaching path, within which the first buckle body is not in contact with the second buckle body, a contacting path, within which the first buckle body is brought to get in contact with the second buckle body, and a locating path, within which the first buckle body is brought to engage with the second buckle body;

a release opening formed on each of the second snap-fit sections; and the first buckle body being movable along a releasing path to separate from the second buckle body via the release openings, the releasing path defining a moving direction that is perpendicular to a moving direction defined by the locating path; and a guide structure being formed on between the first and the second buckle body and including a pair of first guide surfaces formed on the first snap-fit sections at their respective one lateral outer surface and a pair of second guide surfaces formed on the second snap-fit sections at their respective one lateral outer surface; the mutual magnetic attraction of the first and the second magnetic attraction element and the guide structure together enabling the first buckle body to move in different directions when moving along the approaching path, the contacting path and the locating path.

2. The magnetic buckle as claimed in claim 1, wherein the first buckle body moves longitudinally relative to the second buckle body within the approaching path, moves obliquely relative to the second buckle body within the contacting path, and moves laterally relative to the second buckle body within the locating path.

3. The magnetic buckle as claimed in claim 2, wherein the first buckle body moving obliquely within the contacting path moves laterally and longitudinally at the same time; and a direction of the lateral movement of the first buckle body within the locating path is opposite to a direction of the lateral movement of the first buckle body within the contacting path.

4. The magnetic buckle as claimed in claim 1, wherein, when the first buckle body moves along the coupling locus, a relative position of the first and the second magnetic attraction element is changed from an aligned state, in which the first and the second magnetic attraction element completely overlap each other, to a staggered state, in which the first and the second magnetic attraction element partially overlap each other.

5. The magnetic buckle as claimed in claim 1, wherein the first snap-fit sections respectively include an extended arm portion formed on the first buckle body and a protrusion portion formed on the extended arm portion, and the second snap-fit sections respectively include a groove sunken from the second buckle body; and the grooves respectively including a movement space adapted to receive the extended arm portion and the protrusion portion therein at the same time and a snap-fit space adapted to receive only the protrusion portion therein.

6. The magnetic buckle as claimed in claim 1, wherein the first guide surfaces and the second guide surfaces are brought to contact with one another when the first buckle body is moving along the contacting path.

7. The magnetic buckle as claimed in claim 1, wherein the first and the second guide surfaces are inclined in a direction parallel to an extending direction of the contacting path of the coupling locus.

8. The magnetic buckle as claimed in claim 1, wherein the first buckle body includes a first extended section, to which a first belt is coupled; and the second buckle body includes a second extended section, to which a second belt is coupled; and the first and the second extended section being located at two opposite sides of the locating path.

* * * * *